US005362515A

United States Patent [19]

Hayes et al.

[11] Patent Number: 5,362,515

[45] Date of Patent: Nov. 8, 1994

[54] POLY(VINYL ALCOHOL)COPOLYMER SIZES HAVING HIGH CAPACITY TO BE DESIZED

[75] Inventors: Richard A. Hayes, Houston, Tex.; George D. Robinson, Matthews, N.C.

[73] Assignee: E. I. Du Pont de Nemours and Company, Wilmington, Del.

[21] Appl. No.: 203,136

[22] Filed: Feb. 28, 1994

[51] Int. Cl.[5] ..... D06M 15/333

[52] U.S. Cl. ..... 427/155; 427/389.9; 427/352; 8/115.6; 8/138

[58] Field of Search ..... 427/154, 155, 389.9, 427/392, 394, 342, 353, 352; 264/103; 252/156; 8/115.6, 138

[56] References Cited

U.S. PATENT DOCUMENTS

| | | | |
|---|---|---|---|
| 2,290,600 | 7/1942 | Neher et al. | 260/84 |
| 3,689,469 | 9/1972 | Inskip et al. | 260/86.1 |
| 4,013,805 | 3/1977 | Corey et al. | 427/390 R |
| 4,172,930 | 10/1979 | Kajitani et al. | 427/389 |
| 4,205,147 | 5/1980 | Kato et al. | 8/138 |
| 4,383,063 | 5/1983 | Rees | 524/91 |
| 4,640,946 | 2/1987 | Vassallo et al. | 524/45 |
| 4,990,335 | 2/1991 | Bateman et al. | 424/408 |
| 5,231,145 | 7/1993 | Brueckmann et al. | 525/369 |

FOREIGN PATENT DOCUMENTS

| | | |
|---|---|---|
| 0063329 | 10/1982 | European Pat. Off. . |
| 75-32335 | 10/1975 | Japan . |
| 53-010791 | 1/1978 | Japan . |
| 66-007917 | 2/1991 | Japan . |

OTHER PUBLICATIONS

Polyvinyl Alcohol Properties and Applications, Chapter 11 pp. 265–268, no date available.

*Primary Examiner*—Shrive Beck
*Assistant Examiner*—Erma Cameron
*Attorney, Agent, or Firm*—Peter A. Fowell

[57] ABSTRACT

An improved process for producing woven textiles, comprising:

a) sizing yam to be woven, with an aqueous solution of a poly(vinyl alcohol) copolymer containing from about 7 to 15 weight percent units derived frown a comonomer selected from the group consisting of an alkyl acrylate, an alkyl methacrylate, a dialkyl fmnarate and a dialkyl maleate, wherein the alkyl group contains from 1 to 8 carbon atoms;

b) weaving the yam to produce woven textile;

c) desizing the resulting woven textile with an aqueous caustic solution having a concentration between 0.001 and 10 weight percent caustic material in water, and d) optionally washing the caustic desized woven textile with water.

The sizes are very readily desizable, even when the woven textile fabrics have been heat treated.

4 Claims, No Drawings

POLY(VINYL ALCOHOL)COPOLYMER SIZES HAVING HIGH CAPACITY TO BE DESIZED

BACKGROUND OF THE INVENTION

Field of the Invention

This invention relates to an improved process to produce woven textiles. Certain specified poly(vinyl alcohol) copolymer sizes can be advantageously used in the weaving process because they can be readily desized by a process uniquely useful for desizing the particular copolymer sizes. More particularly, the sizes are based on copolymers having a high level of acrylic ester comonomer, and are very readily desized using caustic desizing.

Background of the Invention

Poly(vinyl alcohol) hompolymers, and certain poly(vinyl alcohol) copolymers have been known for use as textile sizes for many years. For convenience, both will be generically referred to hereinafter as PVA(s) or PVA polymers. When specificity requires they will be referred to as PVA homopolymers or homopolymer PVA and PVA copolymers or copolymer PVA. By convention, homopolymer PVA includes PVA derived from homopolymer poly(vinyl acetate) which has been only partially hydrolysed as well as that which has been 'fully' (>98%) hydrolysed. The terms 'fully hydrolysed PVA homopolymer' and 'partially hydrolysed PVA homopolymer' will be used when distinction is necessary. It is also possible to have fully or partially hydrolysed PVA copolymers, though most copolymers are fully hydrolysed. These different PVAs differ quite significantly in properties as textile sizes and in the ability of textiles sized with them to be desized. This difference primarily depends on the degree of hydrolysis and the comonomer content, but also on other factors including molecular weight and thermal history.

PVAs are commonly prepared by alcoholysis of the corresponding poly(vinyl acetate) homopolymer or copolymer. The process is often (though not strictly correctly) referred to as hydrolysis; hence the term 'partially hydrolyzed' when not all the acetate groups are completely converted to alcohol groups. When homopolymer poly(vinyl acetate) is only partially hydrolysed, the PVA is really a vinyl alcohol/vinyl acetate copolymer. However, as noted, such polymers are generally referred to as PVA homopolymers. The term copolymer in this regard is reserved for materials which result from hydrolysis of the corresponding vinyl acetate copolymer, i.e. polymer also containing units derived from a monomer other than vinyl acetate.

Fully hydrolysed PVA homopolymer is highly crystalline, and strong, but because of its high crystallinity it dissolves only in hot, not cold water. Furthermore, when it is subjected to high temperatures, it can develop even higher levels of crystallinity than as prepared, resulting in polymer which is even more difficult to dissolve. Finishing mills with certain fabrics, particularly blend fabrics, tend to use a heat setting condition to relieve fiber stress. The treatment is typically carried out at temperatures which develop further crystallinity in fully hydrolysed PVA homopolymer, so that when such polymer is used as size on fabric, the treatment causes an increase in its crystallinity and a decrease in ease of subsequent desizing.

PVA copolymers and partially hydrolysed PVA homopolymers are less crystalline, and dissolve at lower temperatures, or more rapidly at a given temperature. As a result they desize in water more readily, and are less subject to change in crystallinity and ability to be desized on fabric heat-setting treatments, though not completely free of such change. For a given level of comonomer or residual unhydrolyzed acetate units however, the two types of PVAs are not identical in several respects. This is partly because the distribution of comonomer units (or lactone units derived frown such comonomer units) along the polymer chain is not the same as the distribution of residual acetate units along the chain after partial hydrolysis. One difference, for instance, is that acetate units tend to be blocky, and blockiness of partially hydrolysed PVA causes more surfactant behavior and more foaming when used as size.

Various PVA copolymers have been disclosed as being useful for textile sizes. U.S. Pat. No. 3,689,469 (Inskip et al.) discloses PVA copolymers with 2 to 6.5 weight percent methyl methacrylate as comonomer which are useful as textile sizes, and compares their properties as sizes with fully hydrolysed and partially hydrolysed PVA homopolymer. It is suggested that some of the methacrylate ester units may form lactone units with adjacent vinyl alcohol units. The disclosure indicates, that above about 6 weight percent methyl methacrylate such copolymers are excessively water soluble.

PVA copolymers containing 1 to 10 mole percent methyl acrylate or methyl methacrylate as comonomer are disclosed in U.S. Pat. No. 4, 990,335 (Bateman et al.). (For methyl acrylate this corresponds to about 2 to 16 weight percent methyl acrylate in the polymer, calculated as non-lactonized vinyl alcohol copolymer). The polymers are disclosed as being useful for certain tableting applications. There is no suggestion for use of such polymers as a textile size.

Japanese Patent No. 75-32355 discloses modified poly(vinyl alcohol) polymer fiber sizing agents containing 0.1 to 15 mole % lactone rings. In an example, cotton fabric sized with a 4.7 mole % lactone polymer prepared by saponifying a poly(vinyl acetate/methyl acrylate) copolymer with 4.5% methyl acrylate (which corresponds to 4.7 mole% lactone when the comonomer is fully lactonized, and to about 8.1 weight percent methyl acrylate calculated as non-lactonized vinyl alcohol copolymer) had better scouting fastness than homopolymer PVA.

Desizing usually involves washing with water. However desizing of certain polymers using caustic solution is sometimes used, and has been described. U.S. Pat. No. 4,013,805 (Corey et al.) discloses a poly(vinyl acetate) copolymer which contains a comonomer with free carboxylic acid groups derived from a monomer such as acrylic acid, which can be desized with aqueous base. The poly(vinyl acetate) copolymer is not hydrolysed to the corresponding poly(vinyl alcohol) copolymer.

Desizing of wax-free PVA polymer or copolymer sizes where the copolymer may contain up to 6 weight percent methyl methacrylate or other comonomers, and wherein the size contains an alcohol ethoxylate surfactant, using an alkaline scour bath followed by hot water rinses, is disclosed as being easy compared with comparable sizes with wax but no surfactant, in U.S. Pat. No. 4,640,946 (Vassallo et al.).

U.S. Pat. No. 4,172,930 (Kajitani et al.) discloses a PVA copolymer as textile size where the comonomer is 0.1–10 mole percent of a diacid such as maleic and fumaric acids, but having no monoester, diester or anhydride of the diacid. Copolymers containing free acid will be extremely water sensitive.

Solubility and dissolution times of various types of PVA in water and caustic solutions are discussed in 'Polyvinyl Alcohol', John Wiley & Sons Ltd, 1992, Chapter 11, p. 365–368. It is noted there that partially hydrolysed PVA homopolymer dissolves more slowly in caustic solutions than in water, whereas PVA copolymers with methyl methacrylate as comonomer dissolve more rapidly in caustic than in water. This is explained by the fact that caustic further hydrolyses partially hydrolysed PVA to homopolymer, whereas with the copolymer, lactone tings known to be present are saponified, resulting in ionic groups which are highly soluble. The methyl methacrylate copolymers discussed were designated T-25 and T-66. The mounts of methyl methacryate in those copolymers were not disclosed. Those polymers are manufactured by E. I. du Pont de Nemours. They both contain less than 6.5 weight percent methyl methacrylate, calculated on the basis of non-lactonized poly(vinyl alcohol) copolymer.

The whole chapter referred to in the above reference provides a general background to use of poly(vinyl alcohol) copolymers, as well as other materials, in sizing applications.

Many other materials are known for use as textile sizes. Unmodified starches are inexpensive, but they do not generally have as good properties as PVAs, often flaking off the yarn when used as yam sizes. They do not give stable solutions, and often desizing requires use of enzymes. Many modified starches are known which are improvements in various ways over simple starches, but may be considerably more expensive. Polyacrylic sizes are also known and have good properties, but are extremely water sensitive. PVA based sizes may be considered to have, very generally, sizing properties intermediate between starches and polyacrylic sizes. Sizes based on blends of various size materials such as starches and PVA polymers is also known.

Ease of desizing can strongly affect the economics of the weaving process. Many sizing materials are known, each having its particular niche. PVA copolymers are broadly disclosed as being useful for textile sizes. There remains however, a need for PVA size materials which are uniquely able to be readily desized yet which have acceptable water insensitivity, good mechanical properties, and give stable size solutions.

SUMMARY OF INVENTION

The invention concerns fabric sizes which are PVA copolymers containing a very high level of comonomer, which are entirely suitable for use as sizes and are especially suited to desizing when caustic solutions are used.

More particularly, the present invention provides an improved process for producing woven textiles which includes sizing yam with a poly(vinyl alcohol) copolymer containing from about 7 to 15 weight percent units derived from an alkyl acrylate or methacrylate or a dialkyl fumarate or maleate, wherein the alkyl group contains from 1 to 8 carbon atoms, and after weaving into textile fabric, desizing the sized fabric with an aqueous caustic solution having a strength of from 0.1 to 10 weight percent, followed by optionally washing with water.

DETAILED DESCRIPTION OF THE INVENTION

In this disclosure, it should be understood that the use of the term comonomer, when referring to PVA copolymers, as used here and as is conventionally used, refers to the comonomer copolymerized in the poly(vinyl acetate) copolymer before the latter is converted to PVA by alcoholysis. In PVA copolymers, ester comonomer units are subject to reactions with a hydroxyl from an adjacent vinyl alcohol unit to form lactones, and free alcohol from the ester unit. Thus the original ester monomer unit may no longer exist as the same entity as was present in the precursor poly(vinyl acetate) copolymer. Almost complete lactonization of ester groups may occur, though the extent may vary with different comonomers. The use of phrases such as PVA copolymers 'with' or 'containing' a given comonomer and the like should be understood in this context.

PVA copolymers containing up to 15 mole % lactone tings have been disclosed generally as sizing materials. Commercially, PVA copolymers containing up to about 5 weight percent methyl methacrylate are commonly used for textile size compositions. About 6 weight percent methyl methacrylate has been considered the useful upper limit, since, as noted above, higher levels have been regarded as making the polymers too water sensitive.

Surprisingly, PVA copolymers with comonomer levels above 6.5 weight percent of certain acrylate or even methacrylate ester comonomers are uniquely useful as textile sizes. This is because they have a major advantage over previous sizing compositions in that they have now been found to be particularly easy to desize if, instead of the usual water as desizer, caustic solutions are used. In addition, presumably because such polymers have lower crystallinity, and crystallize less readily, the ability to desize using caustic solutions, is far less affected by heat treatment than are copolymers containing less than 6.5 percent ester comonomers.

The chemical nature and solubility characteristics in water and caustic solutions of PVA copolymers containing an ester comonomer has been recognized in a general qualitative way. Heretofore however, it had not been recognized that a major divergence in solubility characteristics between water and caustic solubility occurs when high (greater than 6%) comonomer is present. More importantly, however, it had not been recognized that such a divergence presents an ideal situation for utilization of such copolymers as sizes, because it is possible to desize readily using caustic solutions, yet they can remain relatively insensitive to water.

In general, PVA polymers all have good mechanical properties as sizes. However the desizing advantage of high level ester comonomer PVA copolymers (greater than 6 weight percent ester) make them unique amongst PVA polymers, and as such they have a definite place as size materials. They are also particularly useful as blending polymers for blending with known PVA copolymer size materials or starches to give blend sizes. They can contribute both to the properties of the blend size but most particularly to the overall ease of desizing, because caustic desizing is also advantageous when blends containing the PVA copolymers are used. In blend compositions tested, it has been found that the ease of desizing with caustic solutions is for the most part, very approximately a weighted average of the ability to desize the blend components, rather than being limited by the least readily desized component. This means that if a particular quality characteristic of a size material is desired —strength or adhesion or low cost for instance - but that size material is difficult to desize, then a blend with a PVA copolymer containing a high level of ester comonomer may offer an ideal compromise between properties and ability to desize.

PVA copolymers with acrylate and methacrylate comonomers can be prepared by well known methods which involve preparation of the corresponding poly(-vinyl acetate) copolymer, followed by saponification, alcoholysis or generally 'hydrolysis'. Typical preparation of such poly(vinyl acetate) copolymers and their hydrolysis is given in U.S. Pat. No. 3,689,469 which describes laboratory scale semi-continuous polymerizations, and U.S. Pat. No. 4,990,335 which describes a continuous process for such polymerizations, and particularly for PVA copolymers containing high levels of ester comonomers. The amounts of monomer are adjusted for different levels required in the polymer, and for their different reactivities. These two patents are hereby incorporated by reference.

Methacrylates are more reactive than acrylates, but both are far more reactive than vinyl acetate, so that typically they are completely reacted, while less reactive vinyl acetate has to be stripped off, and would be recycled in a commercial continuous process. Dialkyl maleates are considerably less reactive.

Suitable comonomers in the PVA copolymers useful in this invention are esters of unsaturated monocarboxylic acids and diesters of unsaturated dicarboxylic acids. Generally, they will be referred to in this disclosure as 'ester comonomers'. Free carboxylic acid groups should not be present in the copolymers. Examples of comonomers include alkyl acrylates, methacrylates, dialkyl fumarates and maleates having an alkyl group or groups containing 1 to 8 carbon atoms. Comonomer level can be from 7 to 15 weight percent, calculated on the basis of non-lactonized poly(vinyl alcohol/ester) copolymers. As noted, after alcoholysis, during neutralization of the alkaline catalyst with acid, the comonomer ester group and adjacent vinyl alcohol hyroxyl groups are believed to be largely converted to lactone tings with release of the ester alcohol. There is thus a loss of weight due to the loss of ester alcohol, but the units which are not vinyl alcohol units are lactone units, and will comprise a higher weight percent of the polymer than that of the comonomer, since an adjacent alcohol unit is involved in the lactone unit, which then has two chain carbon atoms.

To obtain above 15 weight percent ester comonomer, calculated on the basis of non-lactonized poly(vinyl alcohol/ester) copolymer, requires a level of ester comonomer in the poly(vinyl acetate) copolymer precursor which makes preparation of the latter difficult. Alkyl acrylates are preferred, and methyl acrylate is most preferred. While the decreased level of crystallinity resulting from increased comonomer levels has, in the past, been assumed to cause very high water sensitivity, based on methyl methacrylate copolymer work, (i.e. tendency to absorb atmospheric moisture and become sticky, which can result in decreased weaving efficiency), this is not necessarily the case. Thus, very surprisingly, it was found that a copolymer containing 9 weight percent methyl acrylate was actually less water sensitive, (dissolved less rapidly as determined by ease of water desizing), than that a ~5.5 weight percent methyl methacryate PVA copolymer or an 88% partially hydrolysed PVA homopolymer. While not limiting ourselves to any particular theory, it is thought that methyl acrylate or other acrylates as comonomer will decrease crystallinity in the resulting copolymer less than methyl methacrylate or other methacrylates do, even if the comonomer derived unit becomes lactonized, because of the lack of a methyl group attached to an in-chain carbon which methyl methacrylate produces when polymerized. Alternatively, differences in the amount of lactonization may be responsible.

Different comonomers will result in varying levels of water sensitivity in the resulting copolymer. The sensitivity will depend on the reduction in crystallinity due to increasing number of comonomer units (or derived lactone units), but will also depend on the net decrease in polarity with increasing comonomer level. While long alkyl chain alkyl acrylates and methacrylates are less polar than short alkyl chain ones, PVA copolymers of long chain acrylates and methacrylates, on lactonization may contain the same in-chain lactone group as any other acrylate or methacrylate respectively. However, methacrylate derived lactone tings will not be the same as acrylate lactone tings. In addition, the amount of lactonization may vary. In any event, any copolymer can be expected to have a water sensitivity which is a balance due to the amount of reduction in crystallinity the comonomer or derived lactone causes, and the overall decreased polarity of the copolymer with increasing comonomer or derived lactone content. All the ester comonomers, and the lactone ring they can form with a vinyl alcohol unit, will be considerably less polar, and hence less water sensitive, than the vinyl alcohol units.

While methacrylate comonomer PVA copolymers are less favored, even here, as the comonomer level is increased significantly, decreased polarity in the copolymer will result. At very high comonomer levels, decreasing polarity will eventually override increasing water sensitivity with decreasing crystallinity. The major advantage of ready desizing at high ester comonomer levels can make high ester methacrylate, as well as acrylate PVA copolymers useful. Such copolymers will be particularly useful as blend components to improve overall desizing of size materials which are difficult to desize.

Sizing may be carded out using solutions of the PVA polymer having a concentration of from 1 to 20 weight percent, preferably from 4 to 12 weight percent. The sizing composition may incorporate other materials typically found in prior art sizing compositions. Such materials may include waxy-type lubricants defoaming surfactants and other surfactants. A skilled artisan will be able to judge what concentration size solution to use to achieve his desired size add-on level, and what additives are best suited to his operation.

Desizing of sized fabrics is commonly carded out using water washing at varying temperatures. Surprisingly, it has been found that with the high comonomer levels of the copolymers of the present invention, desizing can be carded out effectively with caustic solutions, and those caustic solutions can even be very dilute. PVA homopolymers and many PVA copolymers with lower levels of comonomer than the copolymers of this invention desize either less rapidly, or require higher temperatures and/or higher caustic concentrations for the same amount of desizing. Caustic desizing solutions can be as dilute as about 0.001 weight percent, particularly if somewhat elevated temperatures are used to desize, though concentrations above 0.05 weight percent will more often be required. More rapid, lower temperature or more complete desizing occurs as the caustic concentration is increased. However, generally, the caustic will have to be subsequently washed out, so that higher concentration caustic than is adequate should be avoided. The caustic desizing solutions should have at the most a concentration of 10 weight percent. Preferably however, they should be below 2 weight percent, and most preferably between 0.1 and 1.5 weight percent. For any particular PVA copolymer size or blend size, add-on level, fabric heat treatment etc., a suitable concentration for the desizing caustic solution and a suitable temperature for desizing can be readily determined when it has been decided how rapidly and how completely desizing is required. Thus the emphasis may be on the most rapid desizing for economic reasons. Or the emphasis may be on as low temperature desizing as possible because the material is somewhat temperature sensitive. Generally, almost complete desizing is required. There will not be just one concentration and temperature which is suitable, but a range of alternatives. Suitable caustic materials include any of the alkali metal hydroxides or carbonates, i.e. of sodium, potassium or lithium, with sodium hydroxide being preferred. Experiments have shown however that hydroxides are far more efficient than carbonates, and are preferred in most cases. In some textile mills however, conditions may necessitate use of the milder but less efficient carbonates. Adjustments can be made in concentration and time if necessary. While the particular advantage of the compositions occurs when caustic desizing is used, it is of course still possible to use water desizing when necessary.

It is important to recognize that, while the materials of this invention desize in caustic more rapidly and effectively than many known prior art PVA copolymers size materials (and also more effectively than many known natural size materials such as starch), they may desize less effectively when normal (aqueous) desizing is employed. Thus, as previously noted, a 9 weight percent methyl acrylate copolymer could not be desized as effectively as an 88% partially hydrolysed homopolymer or a 5.5 weight percent methyl methacrylate copolymer at 22 deg. C. This can be a significant advantage, since materials which do not desize readily in water will be less water sensitive and, in general, may have less tendency to become sticky in moist environments.

The process of this invention is applicable to any conventional yam. The textile may be woven from either spun fiber yam or filament yam, and may be woven from hydrophilic yam such as cotton or hydrophobic yams such as nylon or polyester or may be woven from combinations of hydrophilic and hydrophobic yams. The sizes are also useful on textiles after weaving for certain finishing processes. They may also be useful for certain finishing processes for fabrics which are not woven, such as knit fabrics.

The high ester copolymers used in the process of this invention may also be adaptable for uses as films such as agricultural mulch films, biodegradable packaging films, water soluble films, and for use as hot melt adhesives, binders and the like.

The PVA copolymer may have a 4% aqueous solution viscosity from 1 to 60 centipoise. Preferably it should be between 3 and 25 centipoise. The skilled artisan will be able to determine the optimum polymer viscosity, polymer size concentration, and add-on level for the particular yam, fabric and weaving conditions he is using.

EXAMPLES

The PVA polymers used in the various examples and comparative examples are listed in Table I. Size solutions were made from these polymers by preparing an 8 weight percent solution of the polymer by dissolving them in water at about 90 deg. C., mixing for about 2 hours. The size solutions were clear and slightly viscous.

Sized fabric samples were prepared as follows. Approximately 2 inch by 2 inch squares of a 7 ounce, all cotton, bleached, duck fabric type 464 obtained from Test Fabrics Inc. were first weighed, then soaked in size solution for about 2 minutes at about 35 deg. C., mixing gently. The samples were then dried by placing on aluminum foil, treated with Teflon lubricant to prevent sticking, at 50 deg. C. in a convection oven for 17 +/−1 hours. They were then cooled in a calcium sulfate desiccated box, and reweighed to determine the amount of size added on. In some cases the samples were heat-treated by placing in a convection oven at 140 deg. C. for 10 minutes.

Desizing tests were carried out by soaking the sized fabric sample in 100 grams of the test desizing medium, (either water or caustic) for 10 minutes with gentle mixing. In some instances when water was used, the sample was further desized by soaking in another 100 grams of water for 10 minutes. In all instances when caustic was used, the sample was subsequently soaked in 100 grams of water for 10 minutes. This subsequent water treatment washes out the caustic as well as providing for slight further desizing. The desized or partially desized samples were then dried in a convection air oven at 140 deg. C. for 1 hour and then allowed to cool in a calcium sulfate desiccated box. Details, are shown in the Tables IIA where only water was used, and Table IIB where caustic was used. Where high ester comonomer PVA copolymer of the invention is used as the size, the example number is listed without the prefix C whether water or caustic is used in the desizing test. Since the process uses a caustic desizing step, they are not actual examples which illustrate the process. When other sizes are used, the prefix C is used to indicate that the desizing test was carried out with polymer which is not included in the process of the invention, and was carried out for comparative purposes. Actual examples using high ester containing PVA copolymer and which also employ caustic de sizing, and thus illustrate the process of the invention, are shown with an asterisk (*). See Table IIB.

While complete desizing is generally considered necessary, the percent desizing in the examples is considered to be an indication of the ease of complete desizing. If the value shown is less than 100%, then longer desizing times, changed caustic concentration or somewhat higher temperatures, whichever is preferred, would be necessary for complete desizing. Examples where a double water wash was carried out indicate continued desizing at a rate such that after the increased desize time, the increased amount desized still shows the same order of desizing ability as for a single desizing treatment.

It can be seen from the data in Table IIA that the high methyl acrylate PVA copolymer used in the present invention is not very readily desized with water at 22 deg. C. despite the high comonomer level (Example #1). In fact it desizes under the test conditions to a lesser extent than the 5-6% methyl methacrylate copolymer (Example C4, the copolymer being referred to as C5M), and to a far less extent than the 88% hydrolysed homopolymer sized fabric (Example C1, where the size is referred to as H88). It can however be desized in water completely at higher temperatures (Examples 2 and 3). Examples C5-C8 and 4-6 show that when the sized fabric is heat treated, all desize less readily than when not heat treated. However, the high acrylate copolymer can still be removed at higher water temperatures. PVA homopolymer size is particularly difficult to remove at ~22 deg. however (Example C11).

Table IIB shows the results of desizing tests using various caustic solution strengths, and includes a comparison of sodium and potassium hydroxide as desizing agents. Tests on the same size with the same strength sodium and potassium hydroxide size indicate little difference in desizing mount for the two hydroxides. In tests using 0.1 weight percent sodium hydroxide as desizing agent, the far higher level of desizing for the high acrylate comonomer, C9A, is seen in comparison with the lower methacryate copolymers. (Examples C13-17, 10, 11 and 13). Note particularly the large difference between desizing mount for the heat treated high acrylate copolymer and the lower methacrylate copolymer (Example 13 versus Example C17). Thermal treatment of the sized fabric also has a much smaller effect on the ability to desized high ester PVA copolymer sizes than on sizes containing less than 6.5 % ester. Thus compare Examples 10 and 13 for C9A copolymer where desize percent drops from 92 to 81, while with C5M, Examples C15 and C17 shows a drop from about 74 to about 38 percent. Examples 12 and 15 show that 0.1% and even 0.05% sodium hydroxide can completely desize the high acrylate copolymer at 50 deg. C. Higher concentration caustic, for example, 1% solutions, can desize the high acrylate copolymer completely, even after heat treatment, at 22 deg. C, (Example 16) while partially hydrolysed homopolymer and lower methacrylate copolymer are not desized completely at this temperature. (Examples C18, 19 and 20).

It will be noted that values higher than 100% desizing are obtained, even with water desizing. This is an artifact, due to the fact that a few percent of the weight of the fabric itself is removed on desizing.

TABLE I

PVA SAMPLES TESTED

| Code | Solution Viscosity | Mole Percent Hydrolysis | Composition Description |
|---|---|---|---|
| H88 | 21-26 | 87-89 | Partially hydrolysed 'homopolymer' |
| H99 | 12-15 | 99.0-99.8 | 'Fully' hydrolysed homopolymer |
| C3M | 24-32 | 99.0-99.8 | Fully hydrolysed copolymer, 3.3-4.3% MMA |
| C5M | 12-15 | 98.0-99.8 | Fully hydrolysed copolymer, 5.0-6.0% MMA |
| C9A | 15-21 | 98.0-99.8 | Fully hydrolysed copolymer, 8.5-10.5% MA |

Polymer code designations summarize the nature of the composition; H for Homopolymer, C for Copolymer 88 for ~88 mole % hydrolysed, M for methyl methacrylate comonomer, and A for methyl acrylate comonomer.
Solution Viscosity in Centipoise, measured on a 4 weight percent solution at 20 deg. C., determined by Hoeppler falling ball method, bond dry basis.
All samples have a solution pH between 5 and 7. All samples have a maximum ash level of 0.7 weight percent calculated as sodium oxide, dry basis.
Comonomer level in copolymer is weight percent, calculated as non-lactonized comonomer unit in the poly(vinyl alcohol) chain. Comonomer abbreviations: MMA = methyl methacrylate MA = methyl acrylate

TABLE IIA

WATER DESIZING TESTS

| Ex. # | PVA in Size | Heat Treatment Y/N | Size Weight (grms) | Desize Solution | Desize Temp. deg. C. | % Size Removed |
|---|---|---|---|---|---|---|
| C1 | H88 | N | .260 | Water | 23 | 66.5 |
| C2 | H99 | N | .182 | Water | 22 | 27.5 |
| C3 | C3M | N | .223 | Water | 22 | 29.7 |
| C4 | C5M | N | .171 | Water | 22 | 51.9 |
| 1 | C9A | N | .207 | Water | 23 | 36.6 |
| 2 | C9A | N | .280 | Water | 50 | 87.1 |
| 3 | C9A | N | .274 | Water | 80 | 102.1 |
| C5 | H88 | Y | .245 | Water | 23 | 58.3 |
| C6 | H99 | Y | .173 | Water | 22 | 17.3 |
| C7 | C3M | Y | .217 | Water | 22 | 15.6 |
| C8 | C5M | Y | .203 | Water | 22 | 31.2 |
| 4 | C9A | Y | .223 | Water | 23 | 23.5 |
| 5 | C9A | Y | .260 | Water | 50 | 68.5 |
| 6 | C9A | Y | .279 | Water | 80 | 102.1 |
| C9 | H99 | N | .164 | Water/water | 22 | 34.6 |
| C10 | C5M | N | .157 | Water/water | 22 | 65.7 |
| 7 | C9A | N | .272 | Water/water | 21.6 | 53.1 |
| 8 | C9A | N | .305 | Water/water | 50 | 96.7 |
| C11 | H99 | Y | .181 | Water/water | 22 | 19.0 |
| C12 | C5M | Y | .159 | Water/water | 22 | 36.6 |
| 9 | C9A | Y | .278 | Water/water | 50 | 86.4 |

TABLE IIB

CAUSTIC DESIZING TESTS

| Ex. # | PVA in Size | Heat Treatment Y/N | Size Weight (grams) | Desize Solution | Desize Temp. Deg. C. | Percent Size Removed |
|---|---|---|---|---|---|---|
| C13 | C3M | N | .165 | .1% NaOH/Water | 22 | 38.8 |
| C14 | C3M | N | .177 | .1% KOH/Water | 22 | 37.6 |
| C15 | C5M | N | .150 | .1% NaOH/Water | 22 | 73.6 |
| 10* | C9A | N | .356 | .1% NaOH/Water | 22 | 92.1 |
| 11* | C9A | N | .299 | .1% KOH/Water | 22 | 93.2 |
| 12* | C9A | N | .261 | .1% NaOH/Water | 50 | 105.1 |
| C16 | C3M | Y | .228 | .1% NaOH/Water | 22 | 16.8 |
| C17 | C5M | Y | .149 | .1% NaOH/Water | 22 | 38.5 |
| 13* | C9A | Y | .330 | .1% NaOH/Water | 22 | 80.9 |
| 14* | C9A | Y | .263 | .05% NaOH/Water | 22 | 40.6 |
| 15* | C9A | Y | .245 | .05% NaOH/Water | 50 | 105.4 |
| C18 | H88 | N | .255 | 1% NaOH/Water | 22 | 55.4 |
| C19 | C5M | N | .144 | 1% NaOH/Water | 22 | 92.5 |
| 16* | C9A | N | .324 | 1% NaOH/Water | 22 | 105.9 |
| C20 | C5M | Y | .177 | 1% NaOH/Water | 22 | 67.0 |
| 17* | C9A | Y | .249 | 1% NaOH/Water | 22 | 107.3 |

TABLE IIB-continued

CAUSTIC DESIZING TESTS

| Ex. # | PVA in Size | Heat Treatment Y/N | Size Weight (grams) | Desize Solution | Desize Temp. Deg. C. | Percent Size Removed |
|---|---|---|---|---|---|---|
| 18* | C9A | Y | .206 | 5% NaOH/Water | 22 | 105.0 |

Notes for Table IIA and IIB.
Fabric samples were approximately 0.5 grams, varying from about 0.45 to 0.65 grams.
Desizing liquid is either water or the caustic solution indicated. Percent is weight percent. NaOH and KOH are sodium and potassium hydroxide. Where two desizing liquids are shown, desizing was carried out in two liquids consecutively.

What is claimed is:

1. A process for producing woven textiles, comprising:

a) sizing yarn to be woven, with an aqueous solution of a poly(vinyl alcohol) copolymer containing from about 7 to 15 weight percent units derived from a comonomer selected from the group consisting of an alkyl acrylate, an alkyl methacrylate, a dialkyl fumarate and a dialkyl maleate, wherein the alkyl groups contains from 1 to 8 carbon atoms;

b) weaving the yam to produce woven textile;

c) desizing the resulting woven textile with an aqueous caustic solution having a concentration between 0.001 and 10 weight percent caustic material in water, and d) optionally washing the caustic desized woven textile with water.

2. The process of claim 1, wherein the poly(vinyl alcohol) copolymer contains units derived from an alkyl acrylate comonomer.

3. The process of claim 2 wherein the caustic material is sodium or potassium hydroxide.

4. The process of claim 3, wherein the caustic solution is a 0.05 to 1 weight percent aqueous solution of sodium hydroxide.

* * * * *